United States Patent [19]

Hoffman et al.

[11] Patent Number: 4,686,333

[45] Date of Patent: Aug. 11, 1987

[54] ELECTRICAL SWITCH ASSEMBLY AND LATCHING SYSTEM THEREFOR

[75] Inventors: Norman E. Hoffman, Harrisburg; Carl D. Oberman, New Cumberland, both of Pa.

[73] Assignee: AMP Incorporated, Harrisburg, Pa.

[21] Appl. No.: 913,057

[22] Filed: Sep. 29, 1986

[51] Int. Cl.[4] ..... H01H 19/04

[52] U.S. Cl. ..... 200/6 B; 200/303; 220/306; 439/600

[58] Field of Search ..... 200/6 B, 303; 174/52 R; 220/306, 307; 339/206 R, 206 P, 63 R, 63 M

[56] References Cited

U.S. PATENT DOCUMENTS

| | | | |
|---|---|---|---|
| 3,792,206 | 2/1974 | Purdy | 200/6 B |
| 3,878,344 | 4/1975 | Lockard | 200/6 B |
| 3,883,705 | 5/1975 | Sebastian et al. | 200/6 B |

OTHER PUBLICATIONS

AMP Catalog 75-332 Revised 7-84, "Dip Switches-Including Autosert Sealed Switches for Automatic Insertion", pp. 22-23, AMP Incorporated, Harrisburg, PA.

*Primary Examiner*—A. D. Pellinen
*Assistant Examiner*—Morris Ginsburg
*Attorney, Agent, or Firm*—Anton P. Ness

[57] ABSTRACT

An inner rectangular housing insertable into a cavity of an outer rectangular housing has latching projections on sidewalls near the bottom to latch into latching recesses on inside surfaces of the sidewalls of the outer housing near the cavity entrance. Endwalls of the inner housing have stress ledges near the bottom to deflect outwardly the endwalls of the outer housing to generate permanent tension which is transferred by integral wall corners to the sidewalls of the outer housing to urge them inwardly to maintain the latched condition of the projections and recesses. Such latching and tensioning is useful in the type of electrical switch assemblies whose housings are under long-term stress, vibration and/or heat even when bonded and sealed.

7 Claims, 7 Drawing Figures

10
18
26
20
22
24
28
3D
30
12
14
16
108
80
32
34
100
106
40
84
126
124
122
128

ELECTRICAL SWITCH ASSEMBLY AND LATCHING SYSTEM THEREFOR

FIELD OF THE INVENTION

The present invention relates to electrical assemblies and more particularly to a latching arrangement therefor.

BACKGROUND OF THE INVENTION

Electrical switch assemblies of the type disclosed in U.S. Pat. No. 3,792,206 include a pair of dielectric cover members which are secured together to enclose a plurality of contact members and a cam member. This particular switch is a binary codable dual in-line package switch for use on a printed circuit board. Certain ones of the contact members are fixed and others have movable contact arms engageable by selectively located lobes along the camshaft of the cam member and deflected against contact sections of the fixed contacts to complete particular circuits. The cam member has an indicator actuation surface accessible through apertures in the cover members for manual rotation to a desired angular position to encode the switch by selectively opening and closing the appropriate circuits. Each of the contact members has a post portion extending outwardly of the assembly to electrically connect with a circuit path of a printed circuit board such as by insertion into a plated throughhole or socket of the board. The cover members are secured together by bonding where the contact post portions exit the switch to provide an environmentally sealed and bonded package.

It is desired to provide a latching system for the cover members of such a switch in order to secure the assembly together to assure that the assembly remains intact during bonding and/or sealing, and remains intact and sealed during handling and in-service use of the switch.

SUMMARY OF THE INVENTION

The present invention comprises latching projections extending outwardly from opposing sidewalls of the bottom or inner cover which latch into corresponding recesses along the inside surfaces of the opposing sidewalls of the upper or outer cover when the inner cover is fully inserted into the outer cover to enclose the cam shaft and contact members. The latches strengthen the sealing bond joint at the bottom between the covers and the contacts where they extend outward from the switch. It further comprises slightly tapered ledges extending outwardly from opposing endwalls of the inner cover which permanently deflect outwardly a slight amount the corresponding endwalls of the outer cover to generate a dynamic tension on the endwalls of the outer cover when full assembly has occurred. This tension on the endwalls is transferred by the corners to induce dynamic stress on the sidewalls of the outer cover to assure that they are continually under inwardly-directed stress. This inwardly-directed stress maintains the latching projections securely latched within the latching recesses even when the covers are subjected to heat and vibration, and also since the covers are subjected to permanent internal stress tending to push the covers vertically apart, resulting from the inner cover holding the cam shaft firmly against at least the detent springs which are urged against the outer cover by the bond joint and by ledges inside near the top.

It is an objective of the present invention to provide an integral latching arrangement to secure together cover members of an assembly such as a binary switch.

It is a further objective hereof to provide a means of assuring the latched condition of the latching arrangement of the cover members during completion of the manufacture of the assembly and during in-service use thereof.

DETAILED DESCRIPTION OF THE PREFERRED EMBODIMENT

Figures 1, 4:
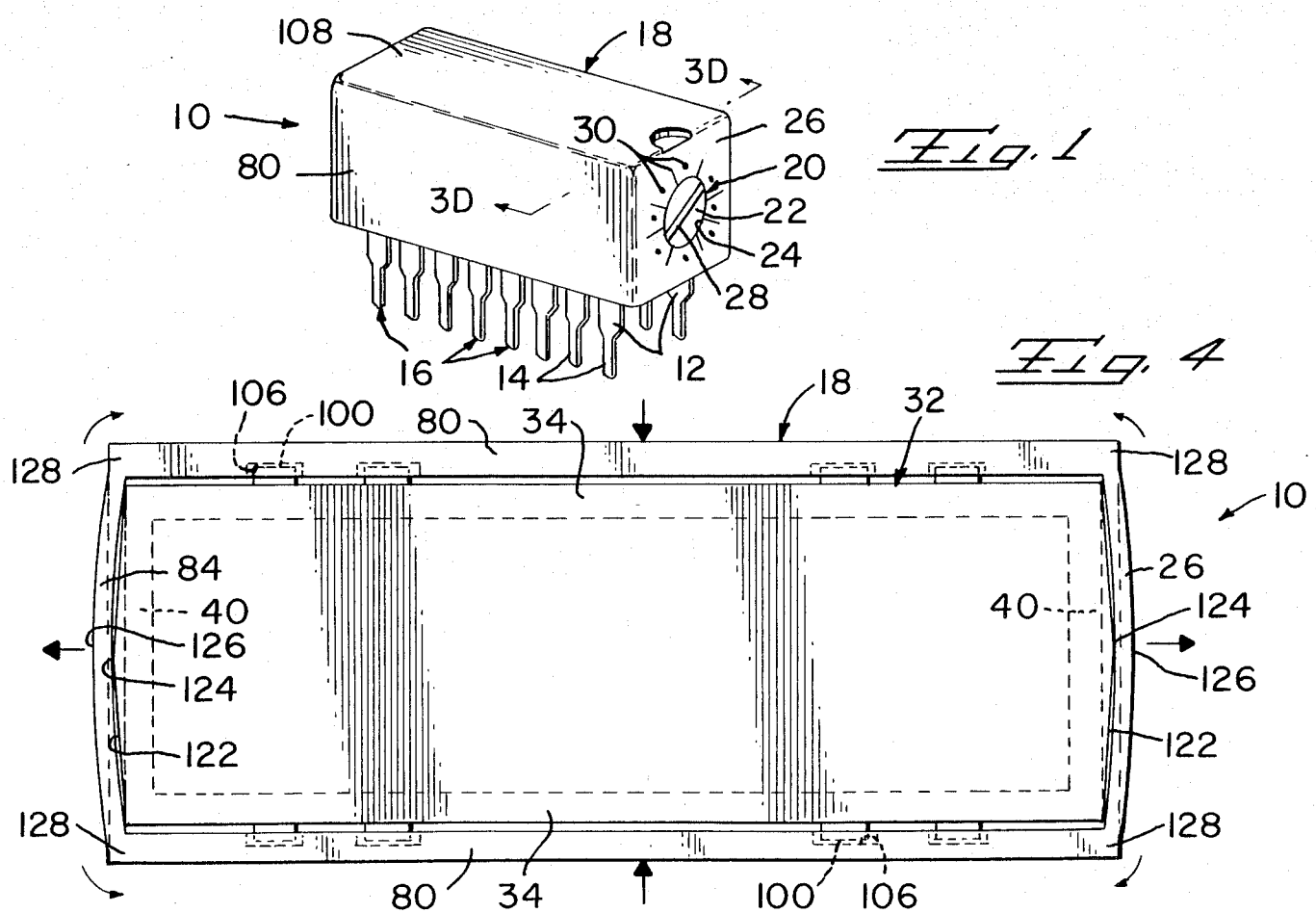
FIG. 1 illustrates a binary switch with which the present invention may be used.
FIG. 4 is a diagrammatic plan view of the latched covers demonstrating the dynamic stress effect of the latching system of the present invention.

In FIG. 1, a binary switch 10 has a dual in-line configuration for being mounted onto a printed circuit board (not shown), with shank 12 and post 14 sections of a plurality of contact members 16 extending downwardly below upper or outer cover member 18 for insertion into sockets or throughholes of the board for electrical connection with circuit paths thereof. Cam member 20 has an actuation surface 22 accessible through an aperture 24 of end wall 26 of outer cover member 18, with a slot 28 enabling rotating of cam member 20 to select by an indicator a desired one of several positions denoted by appropriate markings 30 on endwall 26. Binary switches are known from U.S. Pat. No. 3,792,206 and are sold commercially as indentified in AMP Incorporated Catalog 75-332 (Revised 7-84), pages 22–23.

Figure 2:
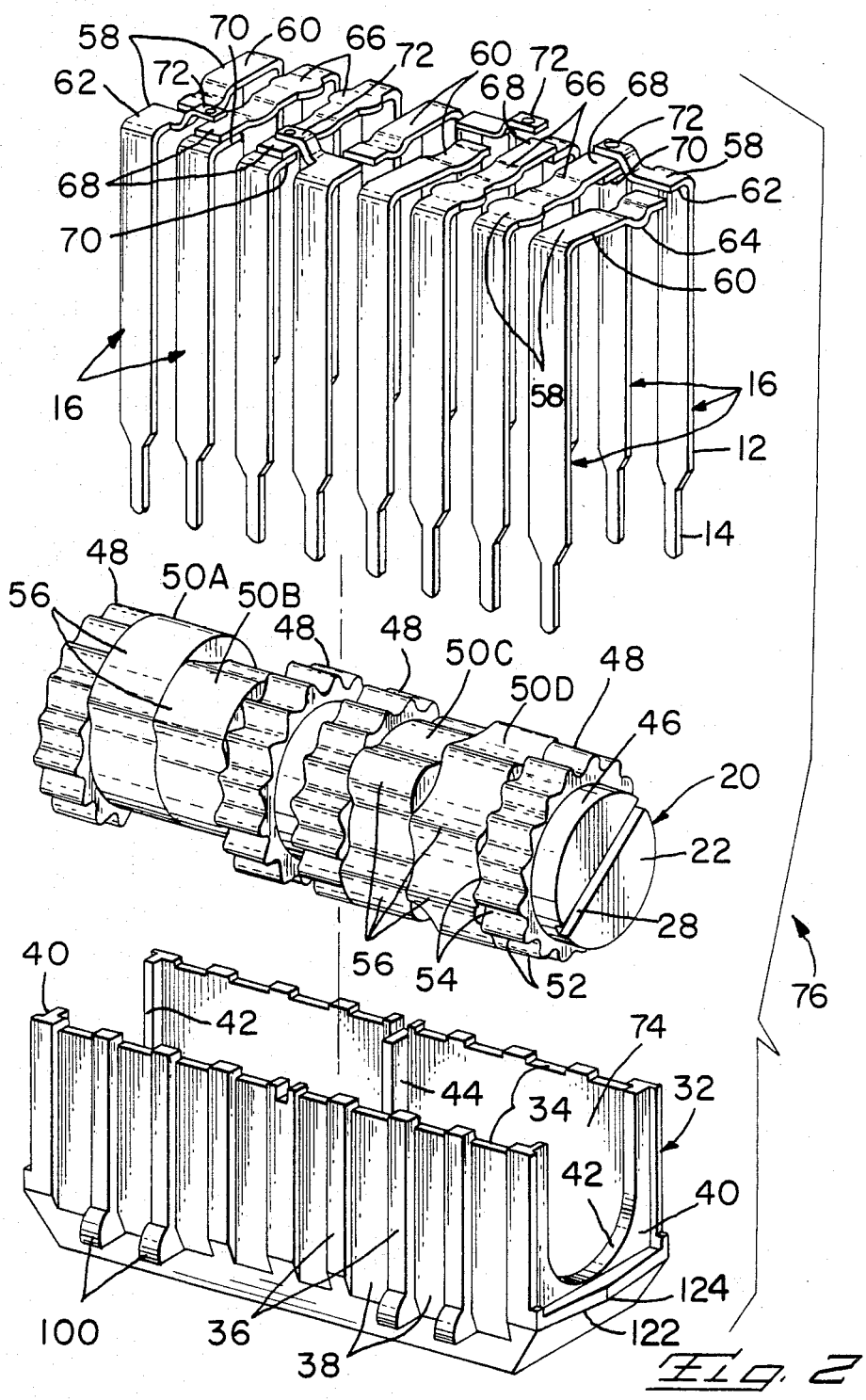
FIG. 2 is an exploded perspective view of the contact members, cam member and lower cover member of the switch of FIG. 1 showing part of the latching arrangement of the present invention.

FIG. 2 illustrates the cam member 20, contact members 16 arranged in opposing pairs, and lower or inner cover member 32 which are assembled with outer cover member 18 to complete the assembly of switch 10, cover members 18,32 comprising the housing. Inner cover member 32 includes opposing sidewalls 34 on the outer surfaces 36 of which are contained vertical grooves 38 which will be associated with shank sections 12 of contact members 16. End walls 40 of inner cover member 32 have elongated U-shaped slots 42 opening upwardly. Intermediate to end walls 40 is a slotted dividing wall 44 to hold cam member 20 against axial movement. Annular bearing surfaces 46 of cam member 20 are received into endwall slots 42 which comprise corresponding bearing surfaces. Cam member 20 comprises a shaft having four detent surfaces 48 and four cam surfaces 50A,50B,50C and 50D positioned as shown. Being a binary switch having sixteen switch positions, the four detent surfaces 48 all have sixteen hills 52, defining sixteen valleys 54 therebetween each corresponding to one of the sixteen positions. Cam surface 50A has one lobe 56 extending around one half its circumference and therefore corresponding to eight contiguous switch positions. Cam surface 50B has two opposing lobes 56 each covering four positions, cam surface 50C has four opposing lobes 56 for two positions each; and cam surface 50D has eight symmetrically spaced single-position lobes 56. The lobes 56 of the four cam surfaces 50A–D are arranged with respect to each other to open or close switch circuits as desired by engaging with or disengaging from deflectable contact arms of corresponding ones of contact member 16.

Extending normally inwardly from shank sections 12 of contact members 16 are end portions 58. One of each pair of contact members 16 adjacent detent surfaces 48 has a long contact arm comprising a detent spring 60 extending almost to a short inner end 62 of the other of the pair. Detent springs 60 are spring loaded against respective detent surfaces 48 of cam member 20 when assembled with detents 64 disposed in respective valleys 54 thereof when assembled so that a firm intentional effort is required to rotate cam member 20, protecting the switch integrity by protecting the cam member against unintentional movement induced by vibration. One of each of the other pairs of contact members 16 adjacent cam surfaces 50 has its end portion 58 comprised of a long movable contact arm 66 whose free end 68 extends to and overlaps end portion 58 of the other of the pair comprised of a short stationary contact arm 70. Overlapping free end 68 of each movable contact arm 66 is stationary contact arm 72 extending laterally from the short inner end 62 of the adjacent contact member associated with a detent surface 48. Each movable contact arm 66 is spring loaded downwardly against stationary contact arm 70 in its uncammed state, but is cammable upwardly against the other associated stationary contact arm 72 when engaged by a lobe 56 of the adjacent cam surface. For convenience of handling during manufacture and assembly all of contact members 16 are stamped and formed from a strip of metal alloy such as for example beryllium copper into a lead frame (not shown). While still integral with the lead frame, contact members 16 are assembled into switch 10; and after complete assembly and bonding and sealing if desired of switch 10, the ends of post sections 14 of contact members 16 are severed from the lead frame carrier strips to create discrete contact members 16.

During assembly, cam member 20 is nestled within cavity 74 of inner cover member 32 with annular bearing surfaces 46 disposed in respective slots 42 thereof, and contact members 16 (on lead frame) are placed over the top of inner cover member 32 such that shank sections 12 extend along vertical grooves 38, forming contact subassembly 76.

In FIGS. 3A to 3D contact subassembly 76 is assembled into cavity 78 of outer cover member 18 to form switch 10. This sequence of views is along a cross-section through the location of first cam surface 50D of cam member 20 and shows the pair of contact members 16 related to cam surface 50D. One of the pair of contact members 16 has long movable contact arm 66 whose free end 68 when switch 10 is fully assembled will be completely disposed between short stationary contact arm 70 of the other of the pair, and stationary contact arm 72 of the adjacent contact member 16 (not shown).

Figure 3B:
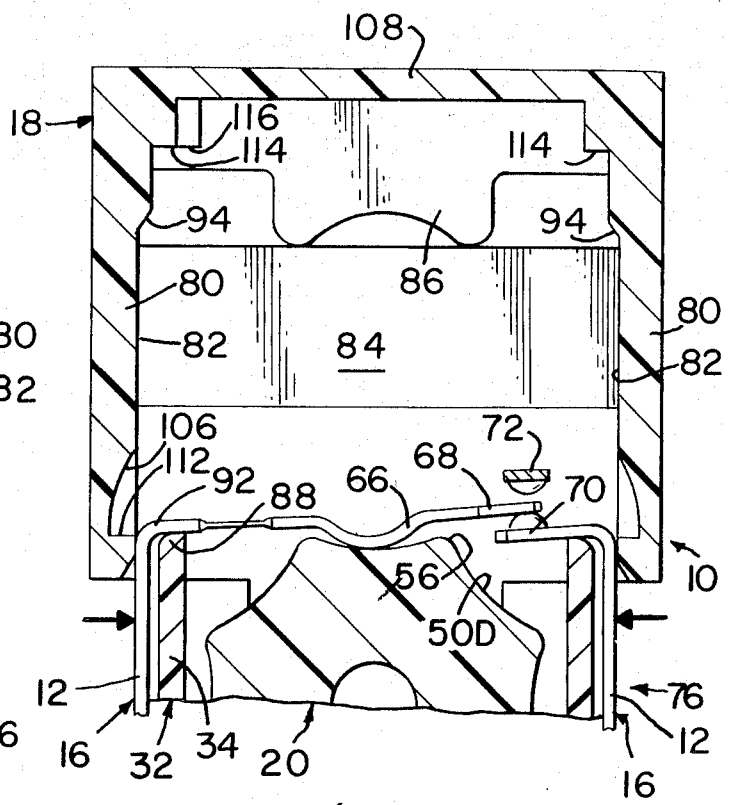
FIGS. 3A to 3D are cross-sectional views through the switch of FIG. 1 during assembly demonstrating the latching of the latching system of the present invention.
Figure 3A:
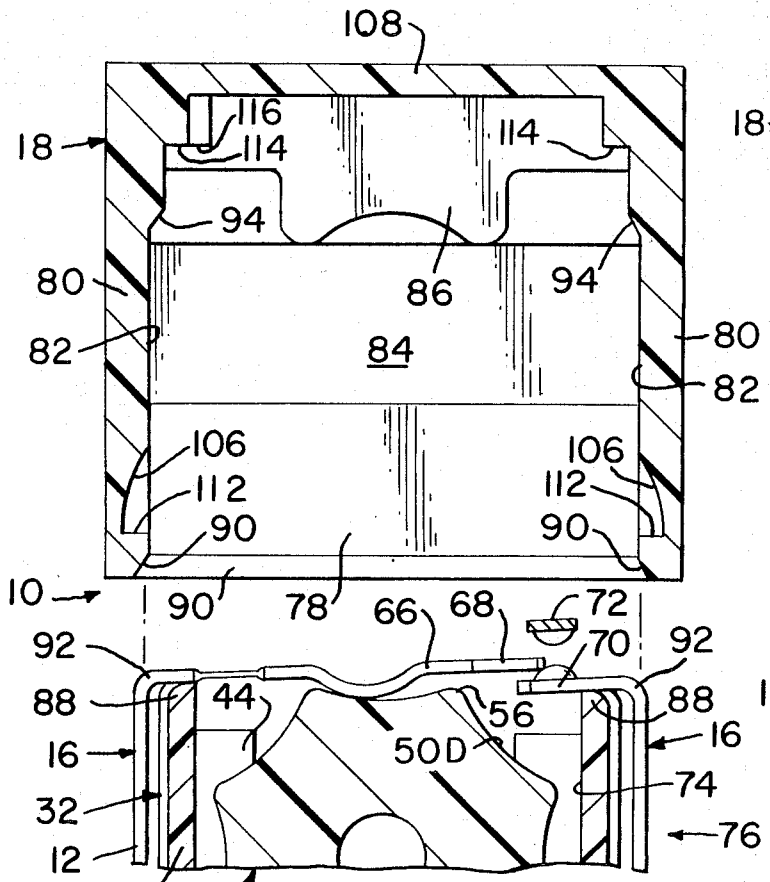

In FIG. 3A outer cover member 18 includes sidewalls 80 having inside surfaces 82. End wall 84 at the far end is opposed from end wall 26 of FIG. 1 which includes aperture 24 related to actuator surface 22 of cam member 20 upon full switch assembly. Sidewalls 80 are integrally joined to end walls 26,84 to be continuous about the entrance to cavity 78. Also seen in FIG. 3A is central dividing wall portion 86 extending downwardly from top wall 108 and across cavity 78 of outer cover member 18 beyond which can be seen the inside surface of end wall 84. A continuous tapered lead-in 90 extends around the entrance to cavity 78 of outer cover member 18. Shank sections 12 of contact members 16 are at first loosely disposed along outer surfaces 36 of inner cover member 32, with end portions 58 disposed atop radiussed top surfaces 88 of sidewalls 34.

When contact subassembly 76 enters cavity 78 of outer cover member 18 as in FIG. 3B, tapered lead-ins 90 of sidewalls 80 engage radiussed bends 92 of contact member 16 and deflect inwardly a slight distance the upper portions of shank sections 12, gathering and aligning the upper portions which are usually slightly non-aligned transversely of contact subassembly 76. As subassembly 76 continues farther into cavity 78, radiussed bends 92 engage tapered surface portions 94 along inside surfaces 82 of outer cover sidewalls 80 near the top of outer cover member 18. The upper portions of shank sections 12 of all contact members 16 are again deflected further inwardly into interference fit against the sides of radiussed ends 88 of inner cover sidewalls 34, and free end 68 of long movable contact arm 66 is now fully disposed between stationary contact arms 70,72.

Figure 3C:
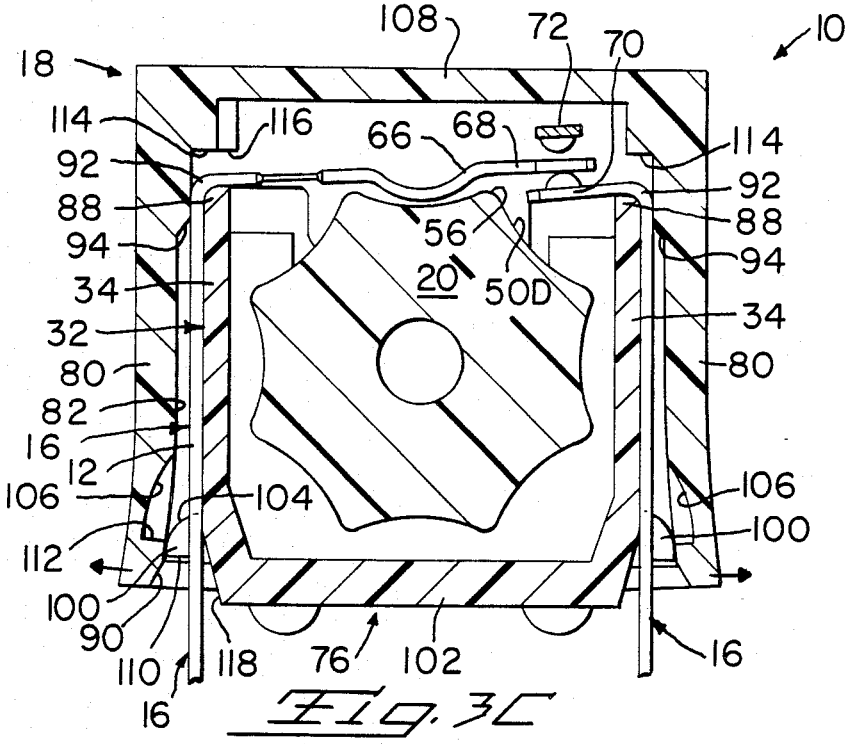

In accordance with the present invention, latching projections 100 extend outwardly from sidewalls 34 of inner cover member 32 proximate bottom wall 102 near both end walls 40. Outer surfaces 104 thereof are tapered or curved and engage lead-ins 90 of outer cover sidewalls 80. Formed along inside surfaces 82 of outer cover sidewalls 80 are latching recesses 106 within which latching projections 100 will latch. Cover members 18 and 32 are preferably molded from thermoplastic resin such as glass-filled polyester, and remote from top wall 108 relatively thin sidewalls 80 of outer cover member 18 are resilient as well as outer cover endwalls 26,84. As can be seen in FIG. 4, at least the bottom portions of end walls 26,84 are thin. Proximate bottom wall 102, inner cover member 32 is rigid and latching projections 100 deflect outer cover sidewalls 80 outwardly, as shown in FIG. 3C.

Figure 3D:
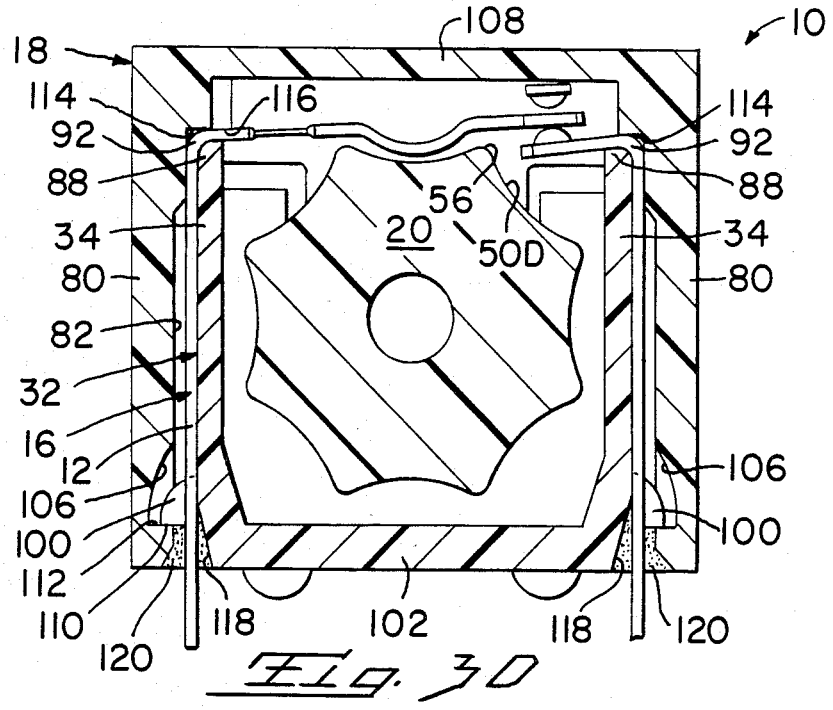

In FIG. 3D, switch 10 has been assembled. Latching projections 100 have entered corresponding latching recesses 106 with respective stop surfaces 110,112 latching against each other. The dimensions of the inner and outer cover members and the locations of the latching projections and recesses thereof are selected such that a tight fit is obtained. End portions 58 of contact member 16 abut or almost abut against ledges 114 on outer cover sidewalls 80 proximate top wall 108. Wide ledges 116 are used at locations of detent surfaces 48 where the respective contact members 16 have long detent springs 60 in order to place fulcrums closer to detents 64 and thereby increase the spring strength of detent springs 60. Bearing surfaces 42 of inner cover member 32 bear against annular bearing surfaces 46 of cam member 20. Tapered surfaces 118 are formed at the bottom of sidewalls 34 of inner cover 32 to create spaces around contact members 16 as they extend outwardly from the housing. Preferably, potting material such as epoxy resin will be placed therein and cured such as by localized infrared radiation which sealingly bonds cover members 18,32 together and forms a sealed joint 120 around shank sections 12 of contact members 16.

From the discussion above, it can be seen that switch 10 when fully assembled is intended to have inherent stress especially between cam member 20 and cover member 32 at their respective bearing surfaces 46 and 42 via spring forces between cam member 20 and at least some contact members 16 at all times. By way of joint 120 and ledges 114,116 contact members 16 transfer stress to outer cover 18, which results in dynamic stress between outer cover member 18 and inner cover member 32. This stress prevents inadvertent changing of position by cam member 20. However, such inherent stress during long-term in-service use and especially when coupled with possible vibration and/or high temperature during in-service use, and even during a localized infrared curing process, can loosen latching projections 100 within recesses 106 and/or bond joint 120 between cover members 18,32.

The tendency to become loose can be overcome with stress ledges 122, shown diagrammatically in FIG. 4, which extend slightly outwardly from the base of end walls 40 of inner cover member 32 and are preferably slightly tapered to a central outwardly extending peak 124. When outer cover member 18 is being placed over contact subassembly 76 just before arriving at the position depicted in FIG. 3C, lead-ins 90 on end walls 26,84 engage stress ledges 122 which deflect slightly outwardly the centers 126 of end walls 26,84 of outer cover member 18 proximate the bottom thereof. The tension in outer cover end walls 26,84 is transferred by corners 128 to induce a dynamic stress force on sidewalls 80 of outer cover member 18 directed inwardly. This stress maintains sidewalls 80 against sidewalls 34 and/or contact shank portions 12 which provides assurance that latching projections 100 will remain latched in latching recesses 106 and reduces tension on the epoxy material at the bottom periphery of switch 10.

The present invention provides a system of latching of a body within an outer housing where the outer housing has latching recesses in resilient walls and the body has complementary latching projections, which system is usable either by itself or in assistance of bonding the two parts. The invention also provides a manner of maintaining tension on the resilient outer walls of the outer housing to assure that the latching projections remain latched in the recesses under adverse conditions. The present invention can be used on assemblies other than the binary switch herein disclosed such as electrical connectors, and is particularly useful in smaller such assemblies. The tension can be generated on end walls of a rectangular housing which secures latches along the sidewalls, but it is believed it could also be performed on one sidewall where the latching is along the opposite sidewall. However, latching on both opposing sidewalls is preferable in the binary switch housing arrangement.

Other modifications may be made in the present invention within the spirit thereof and the scope of the claims.

What is claimed is:

1. A latching system for an assembly comprising a body means and an outer housing means;

outer housing means including a body section and first wall means extending normally from said body section defining a cavity extending rearwardly from an entrance, said first wall means being resilient and integrally continuous about its periphery at least proximate said entrance;

body means including second wall means and adapted to be axially received in said cavity so that said second wall means extend along inside surfaces of said first wall means;

first latching surface means at a selected axial location along said inside surfaces of a selected at least one of said first wall means proximate said cavity entrance and facing said body section of said outer housing means;

second latching surface means along a selected at least one of said second wall means facing away from said body section of said outer housing means at a location corresponding to said first latching surface means to latch therewith upon full insertion of said body means, said body means deflecting outwardly said selected at least one of said first wall means of said outer housing means during insertion and said first wall means thus deflected resiling upon latching of said first and second latching surface means; and projection means on said body means for permanently deflecting outwardly at least another of said first wall means of said outer housing means upon insertion thereby applying tension to said at least another of said first wall means which is transferred to said selected at least one of said first wall means, by said at least another of said first wall means and said selected at least one of said first wall means being integrally continuous which maintains said selected at least one of said first wall means adjacent said body means and thereby maintains said first and second latching surface means latched.

2. A latching system as set forth in claim 1 wherein said projection means comprises a ledge tapered slightly to a central outwardly extending peak.

3. A latching system as set forth in claim 2 wherein said ledge is disposed on opposing end ones of said second wall means at least proximate a transverse plane with said second latching surface means.

4. A latching system as set forth in claim 1 wherein said first latching surface means is disposed on opposing side ones of said first wall means, and said second latching surface means is disposed on opposing ones of said second wall means.

5. A latching system as set forth in claim 4 wherein said second latching surface means is disposed at rearward ends of latching projections, and said first latching surface means is disposed at cavity-entrance-proximate ends of latching recesses corresponding to said latching projections.

6. A binary switch of the type having a first housing, a second housing, a cam shaft member and a plurality of contact members, said first housing having a body section and opposing sidewalls and opposing endwalls integrally joined to each other and extending normally to the body section to define a cavity having an entrance, said second housing having a body section and opposing endwalls and opposing sidewalls extending normally upwardly from the body section to define a cam-receiving cavity, said cam shaft member disposed in said cam-receiving cavity and on bearing surfaces along at least said endwalls and being rotatable therewithin and having annular cam surfaces spaced theralong, and said contact members arranged in pairs and having inner end sections disposed over said cam shaft member and adapted to engage either inner end sections of others of the contact members or a portion of said cam shaft member or both according to a switch position of said cam shaft member to establish a switch condition electrically corresponding to said switch position, and said contact members further having shank sections extending from said inner end sections between the associated sidewalls of the first and second housings and having outer end sections extending outwardly from the bottom of the assembled first and second housings for electrical connection to an electrical article, characterized in that:

latching projections extend outwardly between said shank sections of some of said contact members from said opposing sidewalls of said second housing proximate the bottom thereof;

latching recesses are disposed on inside surfaces of said opposing sidewalls of said first housing proximate said cavity entrance and corresponding to said latching projections;

cooperating latching surfaces are defined on said latching projections and in said latching recesses which latch against each other when said second housing is fully inserted into said first housing;

at least said opposing sidewalls of said first housing are resilient at least proximate said cavity entrance and are deflected outwardly by said latching projections during insertion and resile when said latching projections seat in said latching recesses; and said opposing endwalls of said second housing include ledges extending outwardly therefrom a short distance proximate said body section thereof during insertion to permanently deflect outwardly corresponding said opposing endwalls of said first housing stressing them and generating dynamic tension about corners to said opposing sidewalls of said first housing to urge them inwardly toward said opposing sidewalls of said second housing and assuring the latched condition of said latching projections in said latching recesses.

7. A binary switch as set forth in claim 6 wherein said ledges are tapered to a central outwardly extending peak.

* * * * *